US005302776A

United States Patent [19]

Jeon et al.

[11] Patent Number: 5,302,776

[45] Date of Patent: Apr. 12, 1994

[54] METHOD OF CHORD IN ELECTRONIC MUSICAL INSTRUMENT SYSTEM

[75] Inventors: Ik Beom Jeon, Anyang; Tae Jhin Shin, Seoul; Hyun Cheol Kim, Kwangmyoung, all of Rep. of Korea

[73] Assignee: Gold Star Co., Ltd., Seoul, Rep. of Korea

[21] Appl. No.: 888,483

[22] Filed: May 27, 1992

[30] Foreign Application Priority Data

May 27, 1991 [KR] Rep. of Korea ..... 91-8669
Jun. 26, 1991 [KR] Rep. of Korea ..... 91-10692

[51] Int. Cl.[5] ..... G10H 7/00; G10H 1/38
[52] U.S. Cl. ..... 84/613
[58] Field of Search ..... 84/611, 613, 616, 619

[56] References Cited

U.S. PATENT DOCUMENTS 4,387,618 6/1983 Simmons, Jr. .
4,419,916 12/1983 Aoki .
4,433,601 2/1984 Hall et al. ..... 84/DIG. 12 X
4,499,807 2/1985 Ishida ..... 84/DIG. 22 X
4,539,882 9/1985 Yuzawa .
4,951,544 8/1990 Minamitaka ..... 84/613
5,003,860 4/1991 Minamitaka ..... 84/609
5,085,118 2/1992 Sekizuka ..... 84/635

FOREIGN PATENT DOCUMENTS 2052127 1/1981 United Kingdom .

*Primary Examiner*—William M. Shoop, Jr.
*Assistant Examiner*—Jeffery W. Donels
*Attorney, Agent, or Firm*—Keck, Mahin & Cate

[57] ABSTRACT

A method of automatically generating accompaniment chords in an electronic musical instrument system, whereby, as a melody is advanced, corresponding accompaniment chords can automatically be generated. The method comprises the steps of inputting the key of the tune to be played, drawing up fundamental chords to be used in the play tune according to the input tune key, inputting melody notes, comparing the input melody notes with the notes constituting the fundamental chords to select the highest priority one among the fundamental chords, and outputting the selected highest priority chord, together with the melody notes.

4 Claims, 8 Drawing Sheets

| CHORD NAME | CHORD NOTE | | |
|---|---|---|---|
| C | C | E | G |
| Dm | D | F | A |
| Em | E | G | B |
| F | C | F | A |
| G | G | B | D |
| Am | A | C | E |

| CURRENT CHORD \ PRIORITY | 1 | 2 | 3 | 4 | 5 | 6 |
|---|---|---|---|---|---|---|
| C | C | F | G | Em | Am | Dm |
| Dm | G | Am | C | Em | F | Dm |
| Em | F | G | Am | Dm | Em | C |
| F | C | F | G | Dm | Em | Am |
| G | C | G | Am | Em | Dm | F |
| Am | Dm | F | Em | G | Am | / |

| CANDIDATE CHORD | 'C' Em G | Dm 'F' Am | 'C' Em G | 'C' Em Am | 'C' Em G | 'C' Em Am | Dm 'G' |
|---|---|---|---|---|---|---|---|

| OUTPUT CHORD | C | F | C | C | C | C | G |
|---|---|---|---|---|---|---|---|

METHOD OF CHORD IN ELECTRONIC MUSICAL INSTRUMENT SYSTEM

BACKGROUND OF THE INVENTION

1. Field of the Invention

The present invention relates to a method of automatically generating accompaniment chords in an electronic musical instrument system, whereby, as a melody is advanced, corresponding accompaniment chords can automatically be generated.

2. Description of the Prior Art

Conventionally, an electronic musical instrument system comprises a keyboard for playing the melody part, a keyboard for playing the accompaniment part and select switches for selecting a great number of available timbres, used for the melody. The timbre select switches serve the function of generating sounds of various musical instruments according to the selected states and generating rhythm and bass along with the melody. For this reason, the timbre select switches must be utilized with the melody part keyboard. Therefore, for an auto-play function of accompaniment including an accompaniment chord play function and a great number of other functions such as a rhythm play function for generating the rhythm together with the melody, the melody part keyboard and the accompaniment part keyboard have to be operated together. Usually, however, the accompaniment part keyboard cannot be operated by a player ignorant of the accompaniment chords or by unskilled player. The result then is that there is no provision of the auto-play accompaniment function in the electronic musical instrument system.

SUMMARY OF THE INVENTION

Accordingly, the present invention has been made in view of the above problem, and it is an object of the present invention to provide a method of automatically generating accompaniment chords in an electronic musical instrument system, whereby, as a melody is advanced, corresponding accompaniment chords can automatically be generated.

In accordance with the present invention, in an electronic musical instrument system having a first keyboard for playing the accompaniment part and a second keyboard for playing the melody part, there is provided a method of automatically generating accompaniment chords, comprising the steps of: determining the key of the tune to be played according to key data from said first keyboard; drawing up fundamental chords to be used in the play tune according to the determined tune key; generating melody notes corresponding to key data from said second keyboard; comparing the generated melody note with notes constituting the fundamental chords to select from among the fundamental chords, one with the note equal to the generated melody note; and outputting the selected chord together with the generated melody note.

And, other method of automatically generating accompaniment chord in accordance with the present invention comprises the steps of :

inputting the key of the tune to be played, from said first keyboard;

reading a chord list corresponding to the input tune key and a chord advancing pattern having chord advancing information related to chords included in the chord list;

inputting melody note from said second keyboard;

retrieving from the chord list and chord advancing pattern, candidate chords having respectively note equal to the input melody note and chord advancing information related to the current output chord;

comparing the retrieved candidate chords with the chords from the highest priority to the lowest priority among the retrieved chord advancing information to select from among the retrieved candidate chords, the one equal to the highest priority chord of the retrieved chord advancing information; and outputting the selected candidate chord.

Also, another method of automatically generating accompaniment chord in accordance with the present invention comprises the steps of:

inputting the style of the tune to be played;

reading from a memory, a drum pattern and a chord advancing pattern corresponding to the input tune style;

operating notes and a bass with respect to a series of chords included in the chord advancing pattern; and outputting the read drum pattern, the operated bass and the operated chord-constituting notes.

BRIEF DESCRIPTION OF THE DRAWINGS

The above and other objects, features and advantages of the present invention will be more clearly understood from the following detailed description in conjunction with the accompanying drawings, in which:

FIG. 9 shows an example of automatic chord generation in accordance with the different embodiment of the present invention, wherein:

DETAILED DESCRIPTION OF PREFERRED EMBODIMENTS

Figure 1:
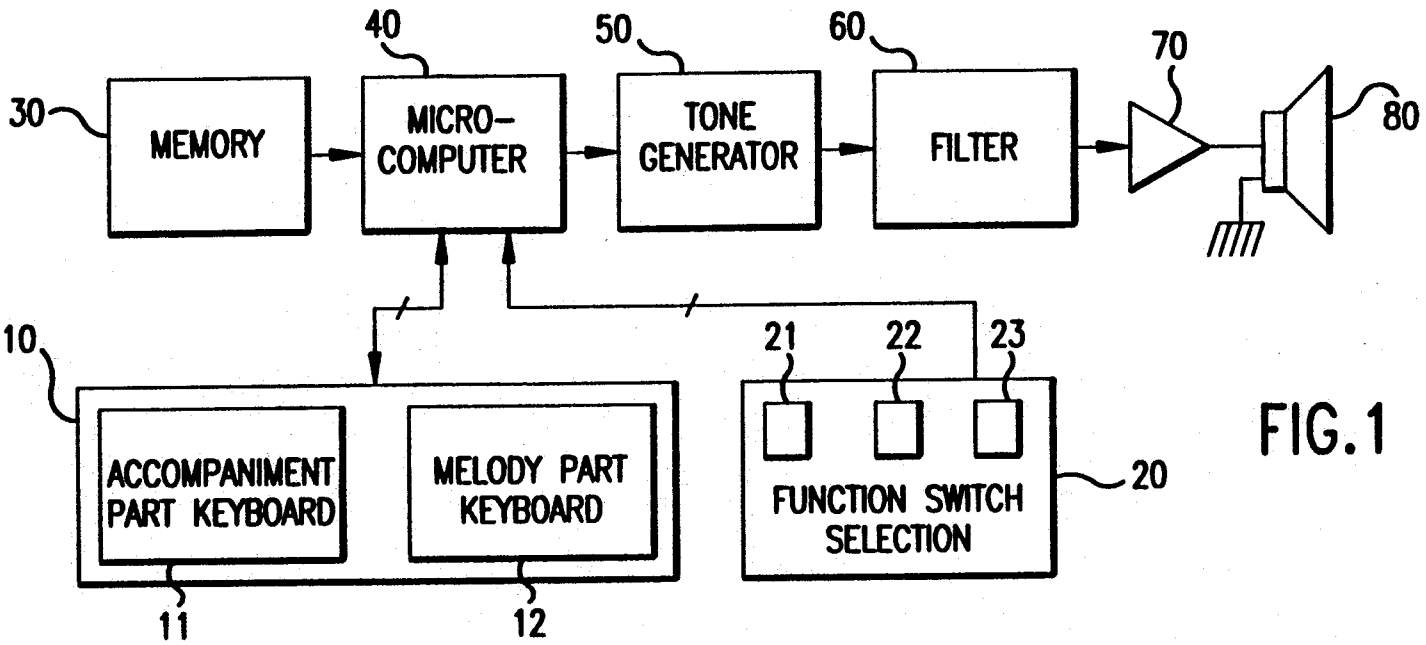
FIG. 1 is a block diagram of an electronic musical instrument system, which is applied to the present invention for the purpose of illustration of the present invention.
Figure 2:
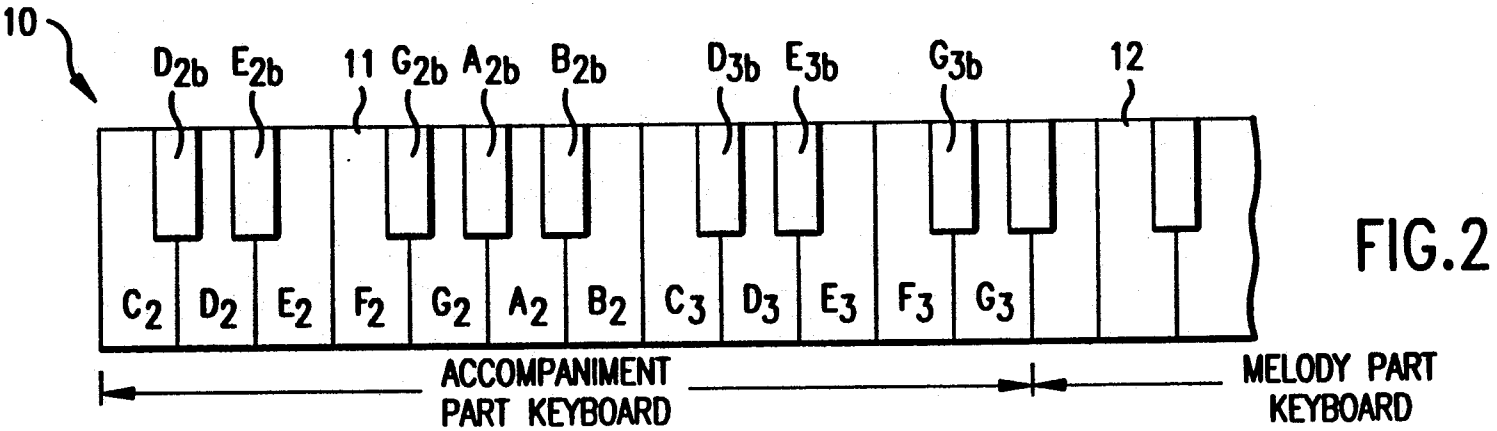
FIG. 2 is a detailed diagram of a keyboard section in the system of FIG. 1.

Referring to FIG. 1, there is illustrated, in block form, an electronic musical instrument system with a keyboard section 10 and a function switch section 20, both of which are coupled to a microcomputer 40. The keyboard section 10 comprises a keyboard 11 for playing the accompaniment part and a keyboard 12 for playing the melody part. The accompaniment part keyboard 11 has a plurality of keys for introducing accompaniment chords and is disposed at the left of the melody part keyboard 12 as shown in FIG. 2. Similarly, the melody part keyboard 12 has a plurality of keys for introducing a melody. The function switch section 20 comprises a rhythm select switch 21 for selecting a rhythm play function, a bass select switch 22 for selecting a bass play function, and a magic chord switch 23 for selecting an auto-play function for the accompaniment chord. Also, the function switch section 20 comprises switches for selecting the style of tune to be played, for example, rock, disco, waltz, etc. and switches for selecting timbres of the melody, in addition to switches 21, 22 and 23.

The electronic musical instrument system also comprises a memory 30 coupled to the microcomputer 40. Stored in the memory 30 are chord list data and chord advancing pattern data. The chord list data consists of the names of the chords which are fundamentally used according to the keys of the played tune, and of the notes which constitute the chords. Chord data is arranged in the chord advancing pattern data in the advancing order to be most used in play. Further stored in the memory 30 are rhythm pattern data and bass pattern data.

The microcomputer 40 included in the electronic musical instrument, as mentioned earlier, feeds accompaniment chord data and melody data corresponding to incoming key data through the keyboard section 10, to a tone generator 50. With the rhythm and bass select switches 21 and 22 selected, the microcomputer 40 reads the rhythm pattern data and the bass pattern data stored in the memory 30, processes the read data along with key data from the melody part keyboard 12 and feeds the processed data to the tone generator 50. Further, the microcomputer 40 generates a timbre control signal according to the selected state of the timbre select switch (not shown) included in the function switch section 20 and feeds the generated timbre control signal to the tone generator 50, the timbre control signal being that control whereby the melody timbre (musical instrument sound) becomes one, or two or more, in number, according to the selected state of the timbre select switch.

Furthermore, with the magic chord switch 23 selected, the microcomputer 40 generates chord data corresponding to the incoming key data through the melody part keyboard 12 and feeds the generated chord data to the tone generator 50, as follows. If the rhythm select switch 21 and the magic chord switch 23 are selected, the microcomputer 40 retrieves the chord list data and the chord advancing pattern data corresponding to the incoming key data through the accompaniment part keyboard 11. Then, if the rhythm and bass select switches 21 and 22 and the magic chord switch 23 are selected, the microcomputer 40 retrieves from the chord list data, chord data, referred to hereinafter as "candidate chord data", containing the sequentially incoming key data through the melody part keyboard 12, and compares the candidate chord data retrieved in the chord advancing order of the chord advancing pattern data with the chord data of the retrieved chord advancing pattern data. As a result of the comparison, the microcomputer 40 feeds the candidate chord data equal to the highest priority chord data of the chord advancing pattern data, together with the note data corresponding to the key data, to the tone generator 50.

Upon receiving the chord data, the melody data, the rhythm data and the bass data from the microcomputer 40, the tone generator 50 generates chord, melody, rhythm and bass signals corresponding to the received data and feeds the generated signals to a filter 60. Also, in response to the timbre control signal being additionally applied from the microcomputer 40, the tone generator 50 generates a plurality of melody signals of different timbres. The filter 60 filters the chord, melody, rhythm and bass signals from the tone generator 50 and feeds the filtered chord, melody, rhythm and bass signals to an amplifier 70, which amplifies the filtered chord, melody, rhythm and bass signals. The amplified signals from the amplifier 70 are sent out through a speaker 80.

Figure 3:
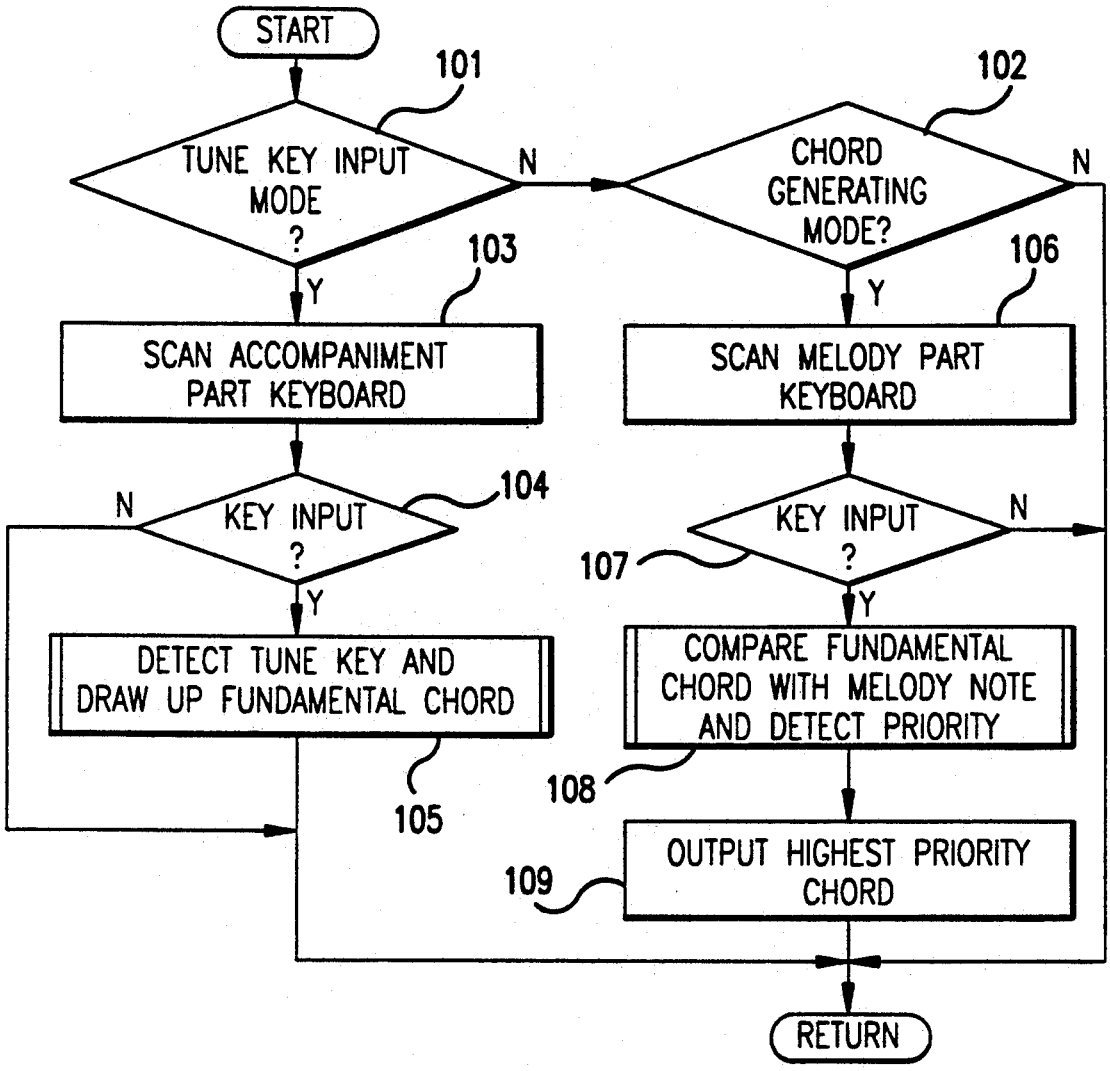
FIG. 3 is a flowchart illustrating a method of automatically generating accompaniment chords in accordance with one embodiment of the present invention.

FIG. 3 is a flowchart illustrating a method of automatically generating accompaniment chords in accordance with one embodiment of the present invention. Now the method illustrated in FIG. 3 will be described in conjunction with the electronic musical instrument system described with reference to FIG. 1.

The microcomputer 40 checks the switched states of the rhythm select switch 21, the bass select switch 22 and the magic chord switch 23 to determine whether the operating mode is a mode of inputting the key of the tune to be played or a mode of automatically generating accompaniment chords according to the melody (steps 101 and 102). With the rhythm select switch 21 and the magic chord switch 23 turned on and the bass select switch 22 turned off, the microcomputer 40 determines that the operating mode is the tune key input mode, and then performs steps 103 to 105. With the rhythm select switch 21, the bass select switch 22 and the magic chord switch 23 all turned on, the microcomputer 40 determines that the operating mode is the automatic accompaniment chord generation mode, and then performs steps 106 to 109. On the other hand, with the rhythm select switch 21, the bass select switch 22 and the magic chord switch 23 all turned off, the microcomputer 40 feeds no rhythm data, bass data or accompaniment chord data to the tone generator 50 and allots the melody part keyboard 12 to the whole of the keyboard section 10, which will then be utilized only as the melody part keyboard 12. Further, with the rhythm select switch 21 and the base select switch 22 turned on and the magic chord switch 23 turned off, the microcomputer 40 feeds the rhythm data and the bass data to the tone generator 50 and splits the keyboard section 10 into the accompaniment part keyboard 11 and the melody part keyboard 12, the bass data being changed according to the key data from the accompaniment part keyboard 11 by the microcomputer 40. On the other hand, if only the rhythm select switch 21 of the switches 21, 22 and 23 is turned on, the microcomputer 40 feeds the rhythm data to the tone generator 50 and allots the melody part keyboard 12 to the whole of the keyboard section 10, which will then be utilized only as the melody part keyboard 12. Also, if only the magic chord switch 23 of the switches 21, 22 and 23 is turned on, the microcomputer 40 feeds no rhythm data and bass data to the tone generator 50 and splits the keyboard section 10 into the accompaniment part keyboard 11 and the melody part keyboard 12.

Determining that the operating mode is the key input mode at step 101, the microcomputer 40 then scans the accompaniment part keyboard 11 (step 103). Then the microcomputer 40 checks whether the scanned key data from the accompaniment part keyboard 11 is present(-step 104). If the scanned key data is present at step 104, the microcomputer 40 detects the key of the tune to be played in response to the scanned key data and draws up fundamental chord data to be used in the play tune on the basis of the detected tune key (step 105), as will hereinafter be described more fully with reference to FIG. 4.

Figure 4:
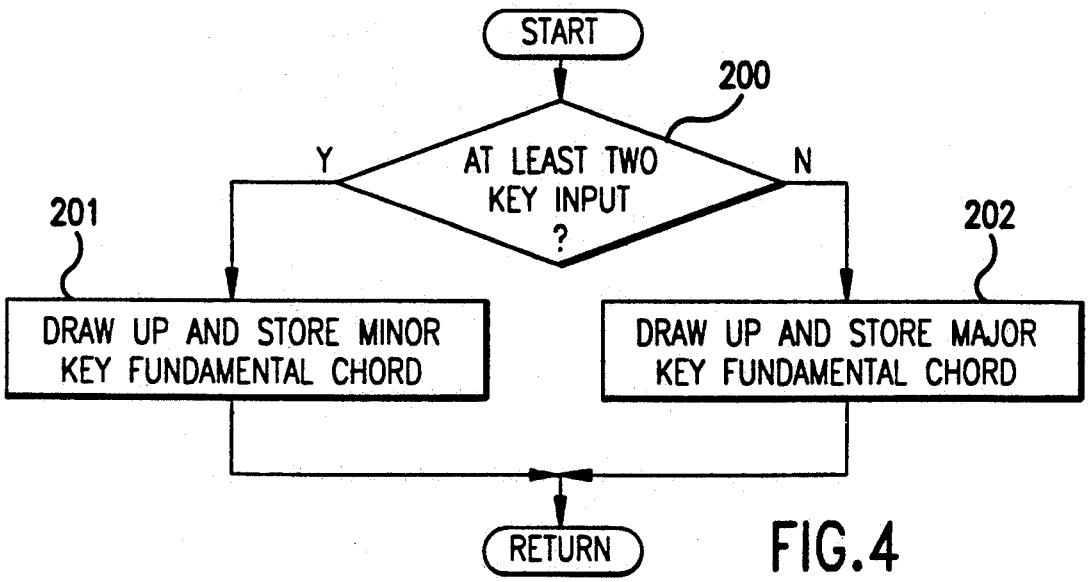
FIG. 4 is a flowchart illustrating, in detail, the operation of determining the key of the tune to be played and of drawing up the fundamental chords in FIG. 3.

Referring to FIG. 4, the microcomputer 40 checks whether the scanned key data is two or more in number to determine if the key of the tune to be played is a major key or a minor key (step 200). The microcomputer 40 determines that the key of the tune to be played is the major key if the scanned key data is one in number, while it determines that the key of the tune to be played is the minor key if the scanned key data is two or more in number. When the key of the tune to be played is the major key, the microcomputer 40 determines the type of the major key in accordance with the logical value of the scanned key data an draws up fundamental chord data for the determined type of the major key on the basis of the musical rule (step 201). For instance, if the logical value of the scanned key data designates "do", the microcomputer 40 determines that the type of the major key is "C" and draws up fundamental chord data to be used in the C major play tune on the basis of the musical rule. On the other hand, when the key of the tune to be played is the minor key, the microcomputer 40 determines the type of the minor key in accordance with the logical values of the scanned two or more key data and draws up fundamental chord data for the determined type of the minor key on the basis of the musical rule (step 202). For instance, if the logical values of the scanned two key data designate "la" and "si", respectively, the microcomputer 40 determines that the type of the minor key is "A" and draws up fundamental chord data to be used in the A minor play tune on the basis of the musical rule. The drawn up fundamental chord data for the major or minor key play tune is stored in an internal memory contained in the microcomputer 40 (steps 201 and 202). The fundamental chord data drawn up at steps 201 and 202 contains tonic chord, dominant chord, subdominant chord and additional chord data.

Figure 6:
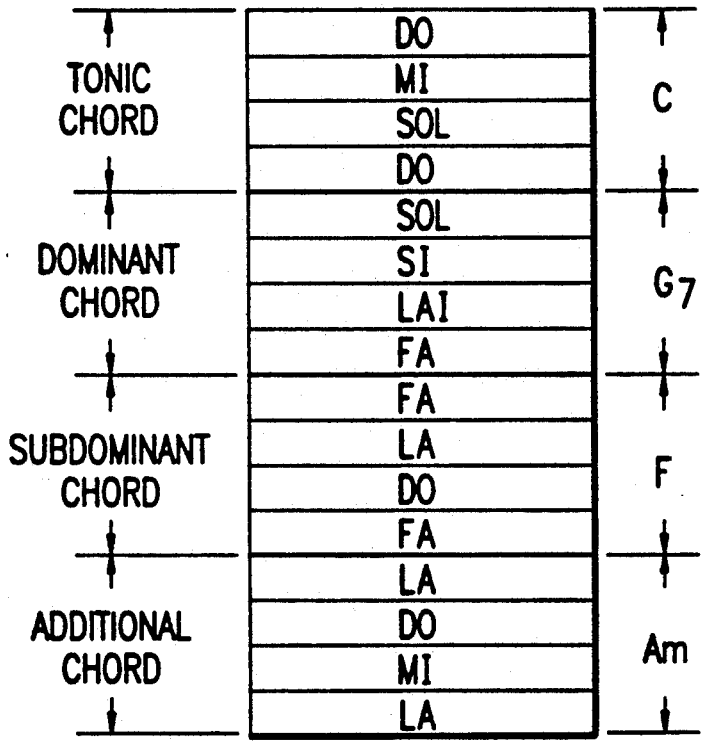
FIG. 6 is a table illustrating an example of the fundamental chords, more specifically, of the fundamental chords for a play tune in the key of C major, in accordance with the embodiment of the present invention specified in FIG. 3.

Referring to FIG. 6, there is shown an example of the fundamental chord data, more specifically, of the fundamental chord data for a play tune in the key of C major, in accordance with this embodiment of the present invention. As shown in this figure, the tonic chord data is C chord data consisting of the note data "do", "mi", "sol" and "do" and the dominant chord data is G7 chord data consisting of note data "sol", "si", "re" and "fa". The subdominant chord data is F chord data consisting of the note data "fa", "la", "do" and "fa". The additional chord data is Am chord data which is frequently used and consists of the note data "la", "do", "mi" and "la".

On the other hand, in the case of a play tune in the key of A minor, the fundamental chord data contains Am chord data as the tonic chord data, E7 chord as the dominant chord data, Dm chord data as the subdominant chord data and C chord data as the additional chord data.

Referring again to FIG. 3, the microcomputer 40 scans the melody part keyboard 12 at step 106. Then the microcomputer 40 checks wheter the scanned key data from the melody part keyboard 12 (step 107)is present. If the scanned key data is present at step 107, the microcomputer 40 performs steps 108 and 109 in sequence. That is, at step 108, the microcomputer 40 retrieves the logical value of the key input data, generates melody note data in accordance with the retrieved result and compares the fundamental chord data with the generated melody note data. As a result of the comparison, the microcomputer 40 selects the highest priority chord data containing note data which is equal to the melody note data and has the highest position value. After performing step 108, the microcomputer 40 feeds the selected highest priority chord data, together with the melody note data, to the tone generator 50 at step 109. Upon receiving the chord data and the melody note data from the microcomputer 40, the tone generator 50 generates chord and melody note signals corresponding to the received data and outputs the generated signals to the speaker 80 through the filter 60 and the amplifier 70.

Figure 5:
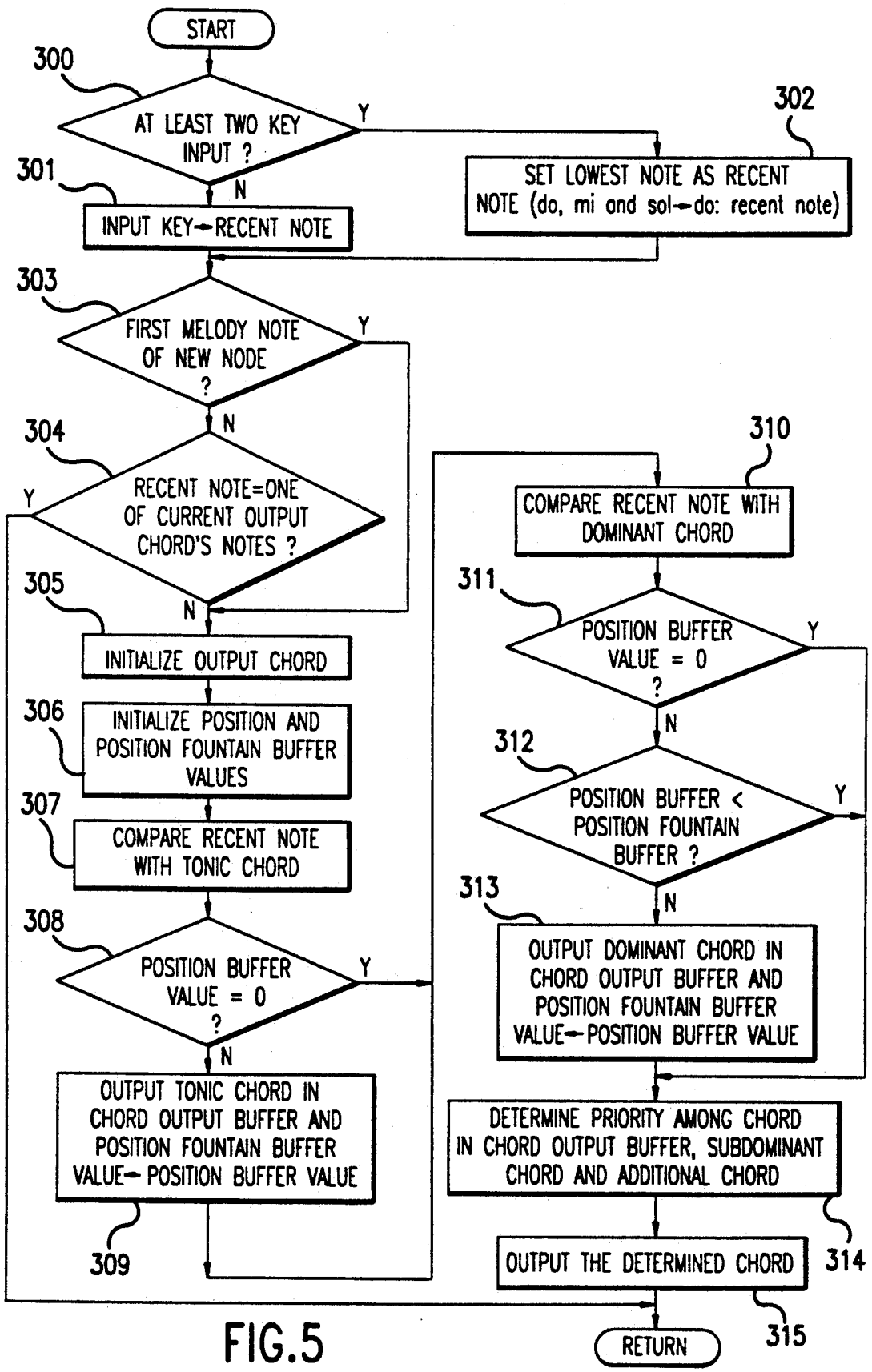
FIG. 5 is a flowchart illustrating, in detail, the operation of determining the priorities of the fundamental chords in FIG. 3.

FIG. 5 is a flowchart illustrating, in detail, the operation (step 108) of selecting the highest priority chord data in FIG. 3. As show in this figure, the microcomputer 40 checks whether the scanned key data is two or more in number (step 300). If the scanned key data is one in number at step 300, the microcomputer 40 generates melody note data according to the logical value of the scanned key data and sets the generated melody note data as recently inputted melody note data, referred to hereinafter as "recent note data", at step 301. On the other hand, if the scanned key data is two or more in number at step 300, the microcomputer 40 generates melody note data according to the logical values of the scanned key data and sets the lowest one among the generated melody note data as the recent note data (step 302).

The microcomputer 40 checks whether a node start flag stored in a rgister contained therein has been set, to determine if the recent note data is the first melody note data of a new node (step 303). With the node start flag set, the microcomputer 40 determines that the recent note data is the first melody note data of a new node. On the contrary, with the node start flag not set, the microcomputer 40 determines that the recent note data is not the first melody note data of a new node. It is noted that the node start flag is set at the start of a node and reset upon output of the first melody note data. This is accomplished by a rhythm count output. If it is determined at step 303 that the recent note data is not the first melody note data of a new node, the microcomputer 40 compares the recent note data with the note data of the current output chord data and determines whether the recent note data is any one of the note data of the current output chord data as a result of the comparison (step 304). If it is determined that the recent note data is any one of the note data of the current output chord data, the microcomputer 40 returns to the main routine, with no change of the current output chord data.

On the other hand, if the recent note data is the first melody note data of a new node, or if the recent note data is neither the first melody note data of a new node nor any one of the note data of the current output chord data, the microcomputer 40 performs steps 305 to 314 to select chord data corresponding to the recent note data. That is, the microcomputer 40 initializes chord data stored in a chord output buffer contained therein (step 305) and initializes values stored in a position buffer and a position fountain buffer contained therein (step 306). The position buffer is adapted to store a position value of the note data of the current comparison chord data, equal to the recent note data. The position fountain buffer is adapted to store the highest position value of the note data of the just before compared chord data, equal to the recent note data. It is also noted that values of "2–4" and "0" can be stored in the position buffer and the position fountain buffer. For example, in a case where a chord to be compared with the recent note is a C chord consisting of the notes of "do", "mi" and "sol", "4" is stored in the position buffer and the position fountain buffer if the recent note is "do" and "3" is stored in the position buffer and the position fountain buffer if the recent note is "mi". Also with the recent note "sol", "2" is stored in the position buffer and the position fountain buffer and, with the recent note "fa", "0" is stored in the position buffer and the position fountain buffer. On the other hand, in a case where a chord to be compared with the recent note is not any one of 7 chords, the microcomputer 40 performs no comparison with the recent note for a "1" position value of one of the notes of that chord.

After performing step 306, the microcomputer 40 compares the recent note data with tonic chord data, to store a position value of the note data of the tonic chord data equal to the recent note data, in the position buffer (step 307). Then the microcomputer 40 checks whether the position value stored in the position buffer is "0" (step 308). If it is determined at step 308 that the position value stored in the position buffer is not "0", the microcomputer 40 stores the position value in the position buffer into the position fountain buffer and stores the tonic chord data into the chord output buffer (step 309).

If it is determined at step 308 that the position value stored in the position buffer is "0", or after performing step 309, the microcomputer 40 compares the recent note data with dominant chord data, to store a position value of the note data of the dominant chord data equal to the recent note data, again in the position buffer (step 310). Then the microcomputer 40 checks whether the position value stored in the position buffer is "0" (step 311). If it is determined at the step 311 that the position value stored in the position buffer is not "0", the microcomputer 40 compares the position value in the position fountain buffer with the position value in the position buffer, to determine whether the priority of the chord data in the chord output buffer is higher than that of the dominant chord data (step 312). It is noted that if the position value in the position fountain buffer is larger than the position value in the position buffer, the priority of the chord data in the chord output buffer is higher than that of the dominant chord data. conversely, if the position value in the position fountain buffer is smaller than the position value in the position buffer, the priority of the chord data in the chord output buffer is lower than that of the dominant chord data. If it is determined at step 312 that the position value in the position fountain buffer is smaller than the position value in the position buffer, the microcomputer 40 substitutes the chord data stored in the chord output buffer with the dominant chord data and substitutes the position value in the position fountain buffer with the position value in the position buffer (step 313). The microcomputer 40 then performs step 314, if the position value stored in the position buffer at step 310 is "0", or if it is determined at step 312 that the position value in the position fountain buffer is larger than the position value in the position buffer, or after performing step 313.

At step 314, in the same manner as that in the operation determining the priority between the chord data in the chord output buffer an the dominant chord at steps 310 to 313, the microcomputer 40 compares the priorities of the chord data in the chord output buffer, the subdominant chord data and the additional chord data and changes the chord data in the chord output buffer as a result of the comparison.

Therefore, stored in the chord output buffer is chord data with the note data of the highest position value through the steps 305 to 314.

After performing step 314, the microcomputer 40 feeds the chord data stored in the chord output buffer to the tone generator 50 (stop 315).

Figure 7:
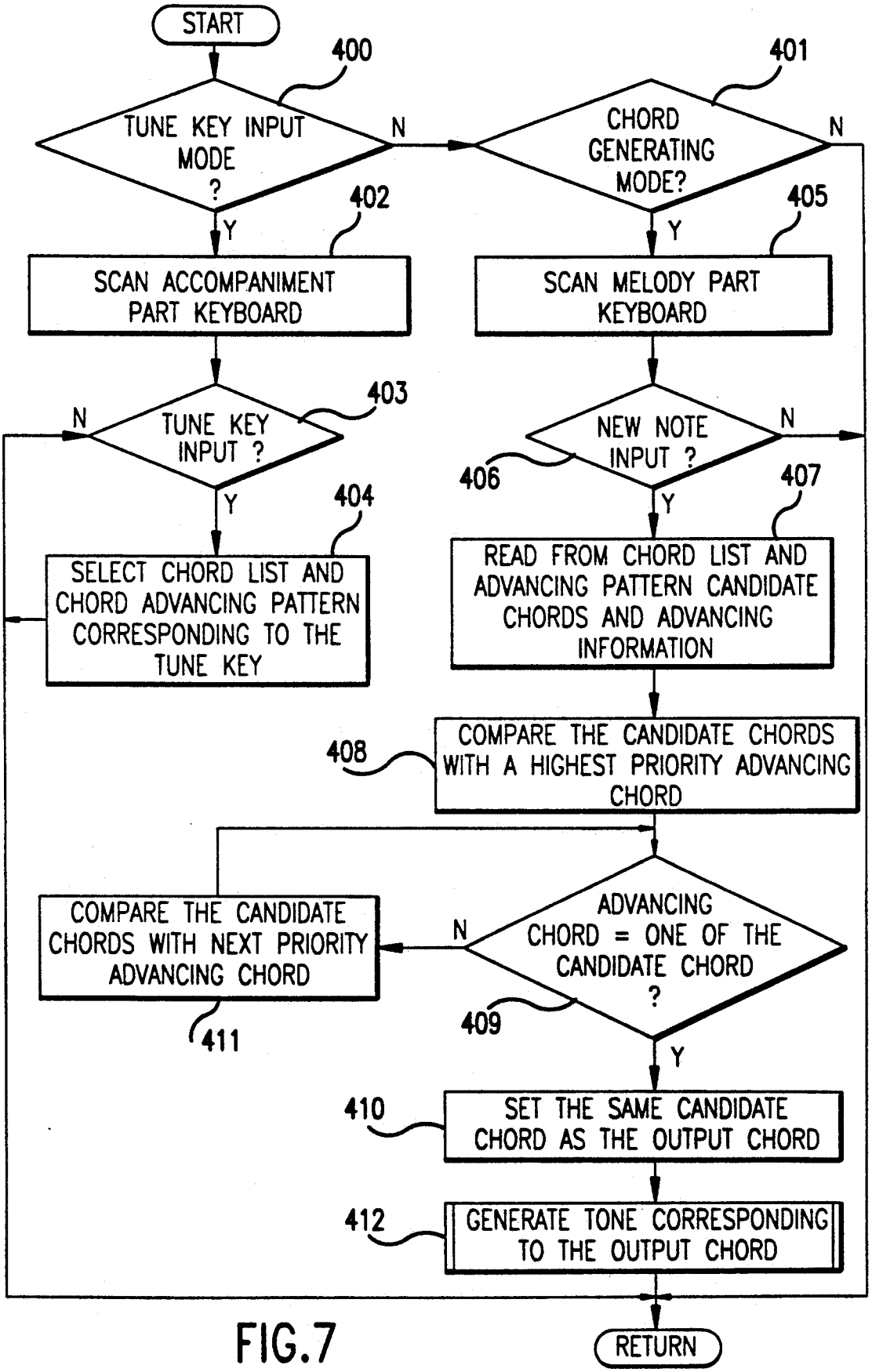
FIG. 7 is a flowchart illustrating a method of automatically generating accompaniment chords in accordance with a different embodiment of the present invention.

FIG. 7 is a flowchart illustrating a method of automatically generating accompaniment chords in accordance with a different embodiment of the present invention. Now the method illustrated in FIG. 7 will be described in conjunction with the electronic musical instrument system described with reference to FIG. 1.

The microcomputer 40 checks the switched states of the rhythm select switch 21, the bass select switch 22 and the magic chord switch 23 to determine whether the operating mode is a mode of inputting the key of the tune to be played or a mode of automatically generating accompaniment chords according to the melody (steps 400 an 401). With the rhythm select switch 21 and the magic chord switch 23 turned on and the bass select switch 2 turned off, the microcomputer 40 determines that the operating mode is the tune key input mode, and then performs steps 402 to 404. With the rhythm select switch 21, tho bass select switch 22 and the magic chord switch 23 all turned on, the microcomputer 40 determines that the operating mode is the automatic accompaniment chord generation mode, and then performs steps 405 to 412.

At step 402, the microcomputer 40 scans the accompaniment keyboard 11. Then the microcomputer 40 checks whether key data from the accompaniment part keyboard 11 is present the scanned (step 403). If no scanned key data is present at step 403, the microcomputer 40 returns to the main routine. On the other hand, if the scanned key data is present at step 403, the microcomputer 40 determines the key of the tune to be played in response to the logical value of the scanned key data and sets last and pattern addresses designating locations of the memory 30 at which are stored chord list data and chord advancing pattern data corresponding to the determined tune key (step 404). The chord list consists of chords which can be used differently in various manners according to the key of the tune to be played.

Figures 8A, 8B, 9A, 9B, 9C:
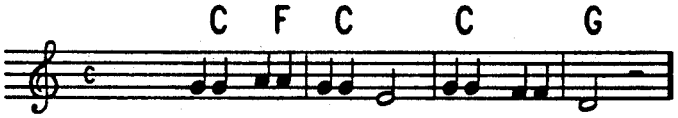
FIG. 8A is a table illustrating an example of a chord list, more specifically, of the chord list for play tunes in the key of C major, in accordance with this different embodiment of the present invention.
FIG. 8B is a table illustrating an example of a chord advancing pattern in accordance with the different embodiment of the present invention.
FIG. 9A is a piece of sheet music showing the melody part of a play tune in the key of C major.
FIG. 9B is a table of candidate chords for the melody notes shown in FIG. 9A.
FIG. 9C shows the chords selected for the melody notes shown in FIG. 9A.

FIG. 8A is a table illustrating an example of the chord list, more specifically, of the chord list for play tones in the key of C major. As shown in this figure, the C major key chord list has C, Dm, Em, F, G and Am chord data. The chord advancing pattern has chord advancing information for respective chord data included in the chord list. The chord advancing information has the chords to be played next to the current chord, the next chords being arranged in the priority order. The priority order is determined according to the harmonious arrangement of the next chords with the current chord.

On the other hand, at step 405, the microcomputer 40 scans the melody part keyboard 12. Then the microcomputer 40 checks whether the scanned key data from the melody part keyboard 12 is present, to determine if a new melody note has been inputted (step 406). If the scanned key data is present at step 406, the microcomputer 40 retrieves the logical value of the scanned key data, generates melody note data corresponding to the retrieved logical value and stores the generated melody note data in its internal memory (step 407). Also at step 407, the microcomputer 40 retrieves candidate chord data with note data equal to the new note data, from the chord data in the current play tune chord list which is stored in the memory 30. After performing step 407, the microcomputer 40 reads the highest priority advancing chord data from among the chord advancing information regarding the current output chord and compares the read chord data with the retrieved candidate chord data in sequence (step 408). As a result of the comparison, the microcomputer 40 determines whether candidate chord data equal to the highest priority advancing chord data is present(-step 409). If it is determined at step 409 that candidate chord data equal to the highest priority advancing chord data is present, the microcomputer 40 sets the same candidate chord data as the output chord data (step 410). On the other hand, if it is determined at step 409 that no candidate chord data equal to the highest priority advancing chord data is present, the microcomputer 40 reads the next priority advancing chord data from the memory 30 and compares the read data with the candidate chord data (step 411). After performing the step 411, the microcomputer 40 performs step 409 again. In sum, at steps 408–411, the microcomputer compares in sequence tho candidate chord data with the advancing chord data from the highest priority to the lowest priority from the chord advancing information regarding the current output chord, in order to retrieve the advancing chord data equal to one of the candidate chord data. Further, the microcomputer 40 feeds the output chord data set at step 410 to the tone generator 50 (step 412). Upon receiving the output chord data from the microcomputer 40, the tone generator 50 generates a chord signal corresponding to the received data and outputs the generated chord signal to the speaker 80 through the filter 60 and the amplifier 70.

FIGS. 9A to 9C show an example of the automatic chord generation by the present method illustrated in FIG. 7, in which FIG. 9A is a piece of sheet music showing the melody part of a C major play tune, FIG. 9B is a table of the candidate chords for the melody notes shown in FIG. 9A, and FIG. 9C shows the chords selected for the melody notes shown in FIG. 9A, the selected chords being the selected ones of the candidate chords in FIG. 9B, which are determined by the chord advancing pattern in FIG. 8B.

Figure 10:
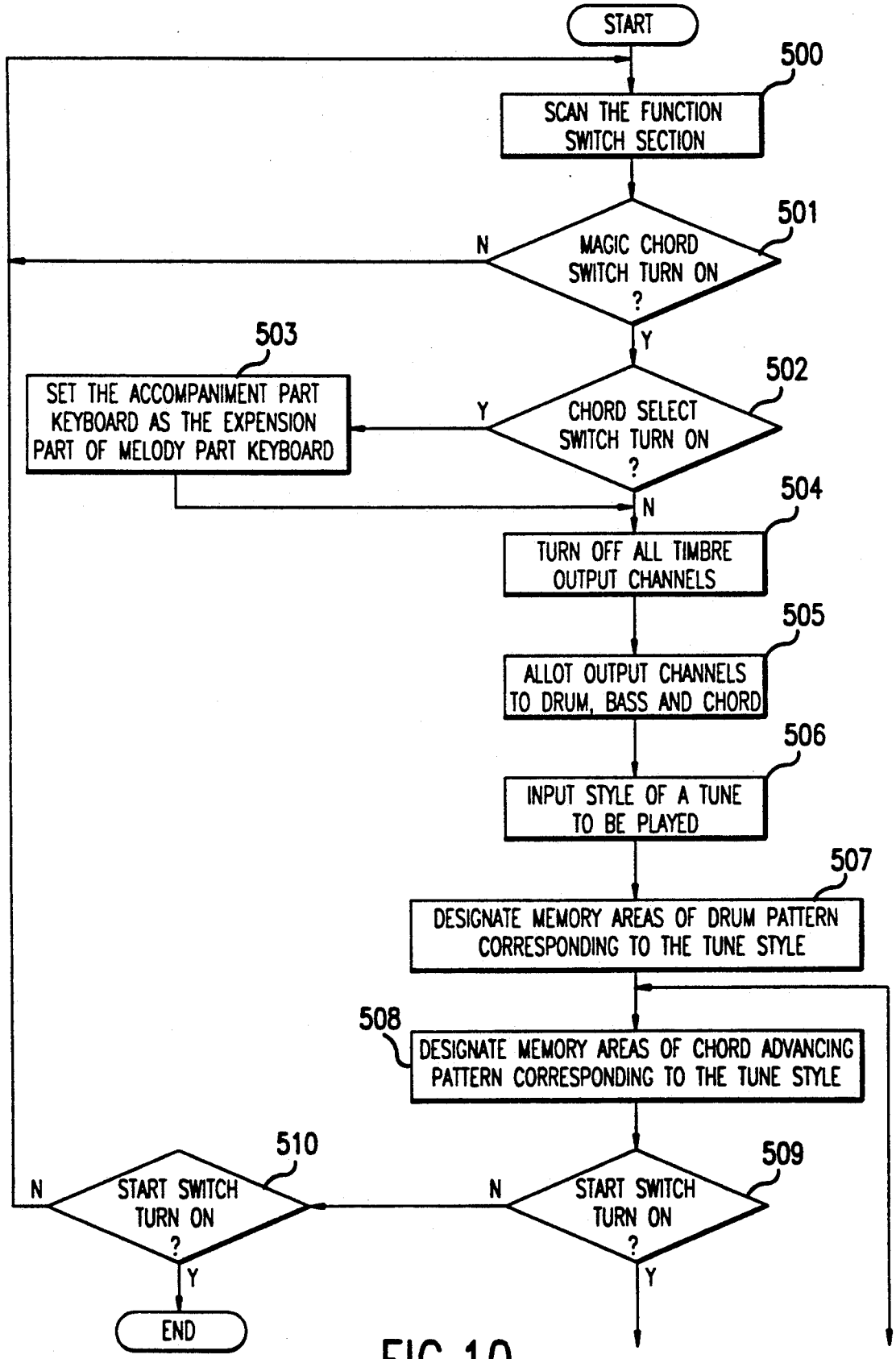
FIG. 10 is a flowchart illustrating a method of automatically generating accompaniment chords in accordance with a further embodiment of the present invention.
Figure 10:
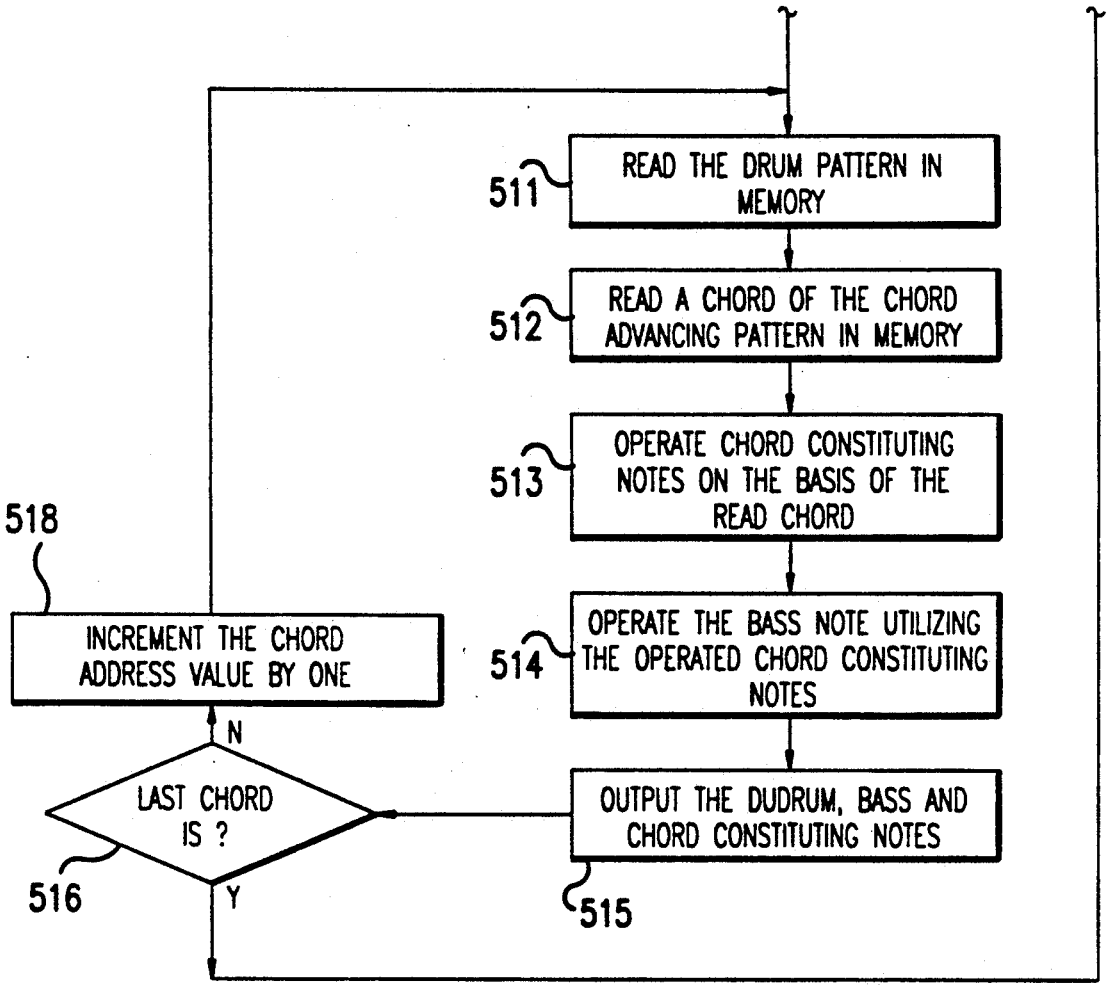

FIG. 10 is a flowchart illustrating a method of automatically generating accompaniment chords in accordance with a further embodiment of the present invention. Now the method illustrated in FIG. 10 will be described in conjunction with the electronic musical instrument system described with reference to FIG. 1.

In FIG. 10, it is assumed that the function switch section 20 in FIG. 1 includes a chord select switch (not shown) for selecting whether the accompaniment part keyboard 11 is operated or not, a start switch (not shown) for starting the accompaniment chord generation and a stop switch (not shown) for stopping the accompaniment chord generation.

The microcomputer 40 scans the function switch section 20 and the keyboard section 10 at a constant interval to check whether the magic chord switch 23 is turned on (steps 500 and 501). If it is determined at step 501 that the magic chord switch 23 is turned on, the microcomputer 40 determines that the operating mode is the automatic accompaniment chord generation mode, and then checks whether the chord select switch is turned on (step 502). With the chord select switch turned on at step 502, the microcomputer 40 allots the melody part keyboard 12 to the whole of the keyboard section 10, which will then be utilized only as the melody part keyboard 12, thereby causing input limitation of the accompaniment chord, but expansion of the melody input range (step 503). Then, the microcomputer 40 controls the tone generator 50 to tune off all timbre output channels (step 504) and thereafter again controls it to allot output channels respectively to drum, bass and chord (step 505). After performing step 505, the microcomputer 40 scans the function switch section 20 to input tho rhythm or style (blues, disco, go-go, etc.) of the tune to be played (step 506). At step 507, the microcomputer 40 sets a drum address designating a location of the memory 30 at which is stored drum pattern data corresponding to the input rhythm or style of the play tune, to designate the corresponding one from among the drum pattern data stored in the memory 30. At step 508, the microcomputer 40 sets a chord address designating a location of the memory 30 at, which is stored chord advancing pattern data corresponding to the input rhythm of the play tune, to designate the corresponding one from among the chord advancing pattern data stored in the memory 30. The drum pattern data stored in the memory 30 has sound and time data. The chord advancing pattern data also stored in the memory 30 consists of chord names and chord data, each having at least one note data indicative of whether the chord key is a major key or a minor key. The chord data is arranged in the chord advancing pattern data in the most commonly used advancing order, or in the order to be most used according to the rhythm in the play tune.

After performing step 508, the microcomputer 40 checks the switched states of the start and stop switches in the function switch section 20 (steps 509 and 510). With the start switch turned on at step 509, the microcomputer 40 repeatedly performs steps 511 to 517 to generate chord, drum and bass as the chord advancing pattern. On the other hand, with the stop switch turned on at step 510, the microcomputer 40 stops the accompaniment chord generation. Further with the start and stop switches all turned off, the microcomputer 40 returns to step 500.

At step 511, the microcomputer 40 reads drum pattern data from the memory 30 location corresponding to the drum address. Then the microcomputer 40 reads chord data from the memory 30 location corresponding to the chord address (step 512). After performing step 512, the microcomputer 40 operates the chord-constituting note data on the basis of the read chord data (step 513). For example, in a case where the read chord data is C chord data, the operated chord-constituting note data are "do", "mi" and "sol". At step 514, the microcomputer 40 operates the bass data utilizing the operated chord constituting note data. After performing step 514, the microcomputer 40 feeds the read drum pattern data, the operated chord constituting note data and the operated bass data to the tone generator 50 (step 515). Upon receiving the read drum pattern data, the operated chord-constituting note data and the operated bass data from the microcomputer 40, the tone generator 50 generates drum, chord and bass signals corresponding to the received data and outputs the generated signals to the speaker 80 through the filter 60 and amplifier 70. Thereafter, the microcomputer 40 checks the chord address to determine whether the current output chord data is the last chord data of the chord advancing pattern data (step 516). If it is determined at step 516 that the current output chord data is the last chord data of th chord advancing pattern data, the microcomputer 40 returns to step 108. On the other hand, if the current output chord data is not the last chord data of the chord advancing pattern data, the microcomputer 40 increments the chord address value by one (step 517). After performing step 517, the microcomputer 40 performs step 511 again.

As herein described above, according to the present invention, the automatic accompaniment chord generaton s achieved by selecting chords to be used according to the key of the tune to be played and selecting chords with notes corresponding to the melody notes as the melody is advanced. Therefore, the present invention can provide an electronic musical instrument system which a player ignorant of the accompaniment chords or an unskilled player can readily handle.

It is understood that although the preferred embodiments of the present invention have been illustrated and described above, alternatives and equivalents thereof will become apparent to those skilled in the art and, accordingly, the scope of the present invention should be defined only by the appended claims and equivalents thereof.

What is claimed is:

1. In an electronic musical instrument system having a first keyboard for playing the accompaniment part and a second keyboard for playing the melody part, a method of automatically generating accompaniment chords comprising the steps of:

determining the key signature of music to be played according to key data from said first keyboard;

drawing up primary chords to be used in the play tune according to the determined key signature;

generating a melody note corresponding to key data from said second keyboard;

comparing the generated melody note with the notes constituting the primary chords;

selecting one or more chords which include the same note as the generated melody note in said note comparing step;

comparing position values of the chord-constituting notes equal to the generated melody note with one another when at least two chords are selected in said selecting step; and outputting with the generated melody note said selected chord when only one chord is selected in said selecting step, and a chord which includes the note having the highest position value in said position-value comparing step when at least two chords are selected in said selecting step.

2. The method as set forth in claim 1, wherein the fundamental chords includes a tonic chord, a dominant chord, a subdominant and an additional chord.

3. The method as set forth in claim 1, wherein the key signature determining step includes determining that the key signature is major key when the key data from said second keyboard is one in number and determining that the key signature is a minor key when the key data from said second keyboard is at least two in number.

4. In an electronic musical instrument system having a first keyboard for playing the accompaniment part and a second keyboard for playing the melody part, a method of automatically generating accompaniment chords comprising the steps of:

inputting the key signature of music to be played, from said first keyboard;

reading a chord list corresponding to the input key signature and a chord advancing pattern having chord advancing information related to chords included in the chord list;

inputting melody notes from said second keyboard;

retrieving from the chord list and chord advancing pattern, candidate chords having respectively note equal to the input melody note and chord advancing information related to the current output chord;

comparing the retrieved candidate chords with the chords from the highest priority to the lowest priority among the retrieved chord advancing information to select from among the retrieved candidated chords, the one equal to the highest priority chord of the retrieved chord advancing information; and outputting the selected candidate chord.

* * * * *

UNITED STATES PATENT AND TRADEMARK OFFICE

CERTIFICATE OF CORRECTION

PATENT NO. : 5,302,776
DATED : April 12, 1994
INVENTOR(S) : Ik Beom JEON, et al.

It is certified that error appears in the above-indentified patent and that said Letters Patent is hereby corrected as shown below:

On the title page, item [54] and column 1, lines 2-3, the title should read --METHOD OF AUTOMATIC CHORD PROGRESSION IN ELECTRONIC MUSICAL INSTRUMENT SYSTEM--

Signed and Sealed this

Fourth Day of October, 1994

*Attest:*

*Attesting Officer*

BRUCE LEHMAN

*Commissioner of Patents and Trademarks*